US006253183B1

(12) United States Patent
Boucard

(10) Patent No.: US 6,253,183 B1
(45) Date of Patent: Jun. 26, 2001

(54) PORTABLE AUDIO RECORDING AND PLAYBACK SYSTEM HAVING PHYSICALLY SEPARATE PLAYBACK AND RECORDING UNITS

(76) Inventor: John C. Boucard, 12544 Constance St., Olathe, KS (US) 66062

( * ) Notice: Subject to any disclaimer, the term of this patent is extended or adjusted under 35 U.S.C. 154(b) by 0 days.

(21) Appl. No.: 09/259,798

(22) Filed: Feb. 26, 1999

(51) Int. Cl.[7] ..... G10L 11/00; G09F 1/00

(52) U.S. Cl. ..... 704/272; 40/124.03; 40/717; 439/53

(58) Field of Search ..... 40/717, 124.03; 704/272, 201; 439/44, 47, 53, 283, 299; 381/123

(56) References Cited

U.S. PATENT DOCUMENTS 5,063,698 11/1991 Johnson et al. .
5,387,108 * 2/1995 Crowell ..... 434/319
5,480,156 * 1/1996 Doederlein et al. ..... 273/237
5,537,292 * 7/1996 Bowen ..... 361/737

OTHER PUBLICATIONS

Information Storage Devices Mar. 1993.*

* cited by examiner

*Primary Examiner*—Forester W. Isen
*Assistant Examiner*—Brian Tyrone Pendleton
(74) *Attorney, Agent, or Firm*—Jordan Sigale

(57) ABSTRACT

Disclosed herein is a portable audio recording and playback system comprised of physically separate audio playback and external recording units, which are operably yet removably mateable. The audio playback unit has a power supply, audio storage, an audio playback device, an audio speaker, a first switch and a first connector all disposed in association with the playback unit housing. The first switch prompts the audio playback device to playback at least one of the audio segments stored in the audio storage. The external recording unit has a microphone, a second switch and a second connector all disposed in association with the recording unit housing. The first and second connectors are configured such that each is operably yet removably mateable to the other. The system also includes an audio recording device operably associated with the microphone and the audio storage and operably connected to the second switch toward prompting the recording device to record one of an audio segment. The audio recording device may be disposed in association with either of the playback unit or the recording unit. A novel manner for mounting the audio speaker within the playback unit housing is also disclosed.

11 Claims, 9 Drawing Sheets

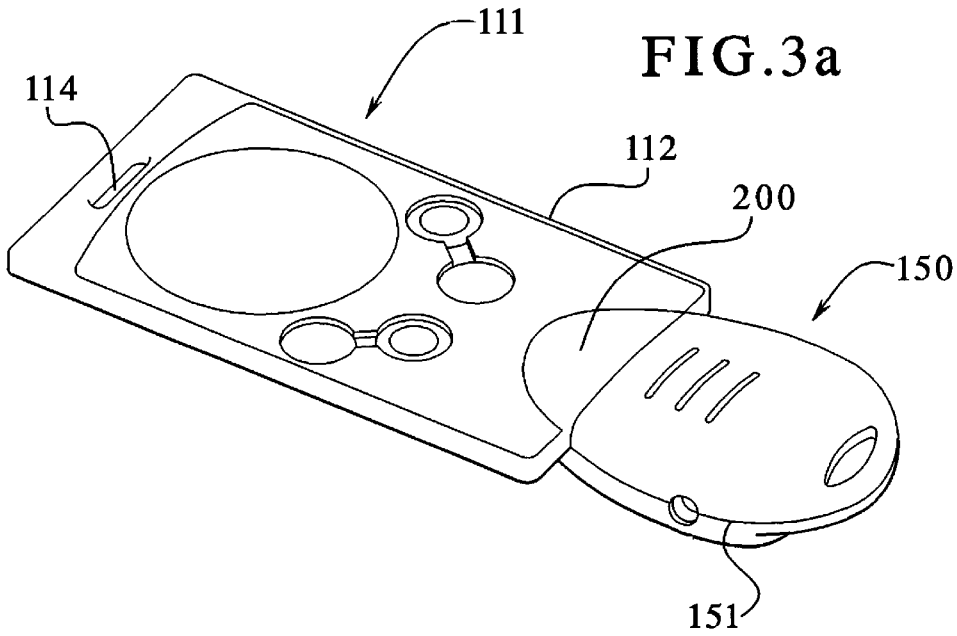
FIG.3a
FIG.3b
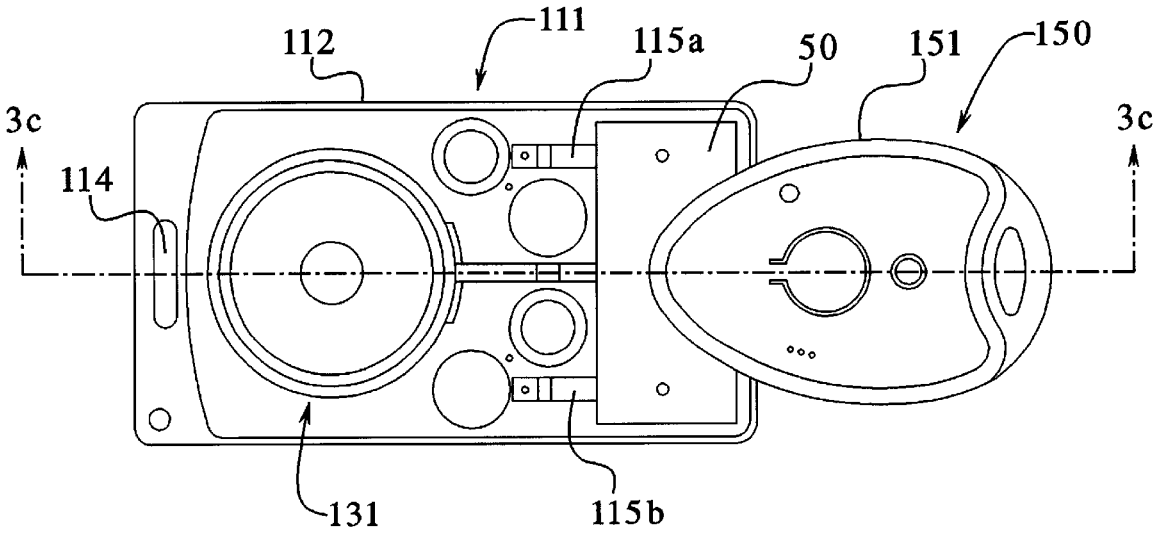

PORTABLE AUDIO RECORDING AND PLAYBACK SYSTEM HAVING PHYSICALLY SEPARATE PLAYBACK AND RECORDING UNITS

BACKGROUND OF THE INVENTION

1. Field of the Invention

This invention relates to a portable recording and playback system, and more particularly, to a customized audio system capable of recording, re-recording, previewing, and transferring audio between an external recording device and a playback module.

2. Background Art

It is common for one giving a gift of a flower arrangement to attach a personalized hand-written note to the arrangement. The written note lacks the vitality and personality of the gift giver's voice and many times the giver is unable to convey a sentiment to the receiver with enough word economy to fit on the card. Additionally, voice tone, inflection and accent are rarely captured effectively in writing. Currently, paper-based promotional products carry high costs with poor functional value, and yet the paper-based products predominate the advertising premium market. Other popular products, such as balloons, coffee mugs and T-shirts have similar print-related limitations.

Hand-held recorders of the prior art are generally too big and bulky to be attached to a floral arrangement or paired with other gifts or promotional products to identify the giver. The prior art recording devices are generally high-cost and therefore not viable for promotional or personal use.

There have been attempts in the prior art to market talking trading and greeting cards. For example, U.S. Pat. No. 5,063,698 discloses a greeting card with an electronic sound recording of a personalized message. U.S. Pat. No. 5,480,156 teaches squeezable trading cards capable of generating recorded sounds. However, the devices of both references do not allow the user to easily customize her messages on a re-recordable card.

Accordingly, it is a primary object of the present invention to provide a quick and easy system for the transmission of audio segments between an external recorder and a credit card-sized sound module for the playback of personalized messages.

It is another object of the present invention to provide a credit card-sized sound module capable of receiving and playing digital audio messages from a computer, CD-player, or recorder via a specially adapted external recorder.

It is another object of the present invention to provide a credit card-sized sound module that has a solid state semiconductor chip for storing short voice messages which can be segmented and arranged by the user.

These and other objects will be apparent to those of ordinary skill in the art having the present drawings, specification and claims before them.

SUMMARY OF THE DISCLOSURE

The present invention comprises, in part, a portable audio recording and playback system having physically separate audio playback and external recording units. These units are operably yet removably mateable such that a single external recording unit can be used in association with a plurality of audio playback units. These audio playback units can then be used as, among other things, talking business cards, talking greeting cards, trading cards and/or distributed with flowers, balloons, in association with toys, action figures or the like to further increase the value of the product.

The audio playback unit portion of the system has a power supply, audio storage, an audio playback device, an audio speaker, a first switch and a first connector all physically disposed in association with a playback unit housing. The audio storage stores at least one audio segment. The audio playback device is operably associated with the audio storage and audio speaker.

In one embodiment, the audio playback unit is capable of sequentially accessing a particular one of a plurality of audio segments that have been stored in the audio storage. In such an embodiment, the audio playback unit also includes an audio selector switch operably connected to prompt the audio playback device to access the next audio segment stored in the audio storage.

The audio speaker is physically associated with the playback unit housing. In a preferred embodiment the speaker is mounted facing the bottom of the housing in registration with a hemispherical audio cavity portion of the housing. In this manner, the audio speaker is substantially protected from damage from external forces by the bottom portion of the playback unit housing. Furthermore, the audio is resonated in the audio cavity and reflected back up to the top of the housing resulting in more pleasing audio quality.

In the preferred embodiment, the playback unit housing includes an at least partially hollow base, which is covered by a flexible sheet having various indicia printed thereon. In this embodiment, the flexible sheet is preferably attached to the base with adhesive. However, it is possible to attach a flexible cover using other approaches, which are known to those of ordinary skill in the art. It is further contemplated that the flexible cover sheet could comprise the back cover of a pamphlet or other printed book.

The first switch, which is physically associated with the playback unit housing, is preferably mounted directly under the top cover of the playback unit housing in registration with an embossed area thereon. This first switch prompts the audio playback device to playback at least one of the audio segments stored in the audio storage.

The external recording unit portion of the system has a microphone, a second switch and a second connector all disposed in association with the recording unit housing. The microphone generates a microphone audio signal, which is transmitted to the audio recording device. In a present embodiment, the audio recording device is physically disposed within playback unit housing. However, the audio recording device may be disposed in association with either of the playback unit or the recording unit. The second switch prompts the audio recording device to record an audio segment. In a preferred embodiment, the external recording device further includes an LED to indicate (when illuminated) that the system is presently recording audio for storage in the audio storage.

The first and second connectors are configured such that each is operably yet removably mateable to the other. The first connector is physically associated with said playback unit housing and operably connected to at least one of the audio playback device and audio storage. The second connector is physically associated with the recording unit housing and operably connected to both the microphone and the second switch. In the preferred embodiment, the second connector is also operably connected to the LED.

In a preferred embodiment, the first connector is physically protected by at least a protective portion of the playback unit housing and the second connector is physically protected by at least a protective portion of the recording unit housing. In fact, in that preferred embodiment, the protective portions of the playback unit and recording unit housing mate with at least portions of one another forming an interference fit. Furthermore, in that preferred embodiment, the interference fit is further strengthen by the second connector, which includes upwardly biased electrically conductive teeth which promote efficient electrical connection between the first and second connectors and further increase frictional engagement between the cooperatively mating portion of the playback unit and recording unit housings.

In one embodiment, the external recording unit also includes a third connector that at least accepts or transmits an external audio signal from or to another audio device. This other audio device may comprise among a myriad of other possibilities, a digital or analog tape recorder or even another playback/external recording unit pair. In this manner, the audio data stored in the audio storage of one playback unit can be transferred out and saved. In this embodiment, the external recording unit also includes a third switch that selects between an external audio signal and the microphone audio signal.

The invention may further include a method for providing a recipient with a recorded message that cannot be modified or replaced. This method involves: (a) obtaining an external recorder unit; (b) obtaining at least one physically separate but mateable audio playback unit having an audio storage for storing at least one message; (c) mating the external recorder unit to one of the at least one audio playback unit in an operable fashion; (d) recording a message on the audio storage of the one of the at least one audio playback unit; (e) disconnecting the external recorder unit from the one of the at least one audio playback unit having the message stored therein; and (f) providing the one of the at least one audio playback unit without the external recorder unit to the recipient.

BRIEF DESCRIPTION OF THE DRAWINGS

FIG. 3*a* of the drawings is a top perspective partial cut-away view of the audio playback unit operably yet removably mated with the external recorder;

FIG. 3*b* of the drawings is a bottom plan partial cut-away view of the audio playback unit operably yet removably mated with the external recorder;

BEST MODES OF PRACTICING THE PRESENT INVENTION

Figure 1:
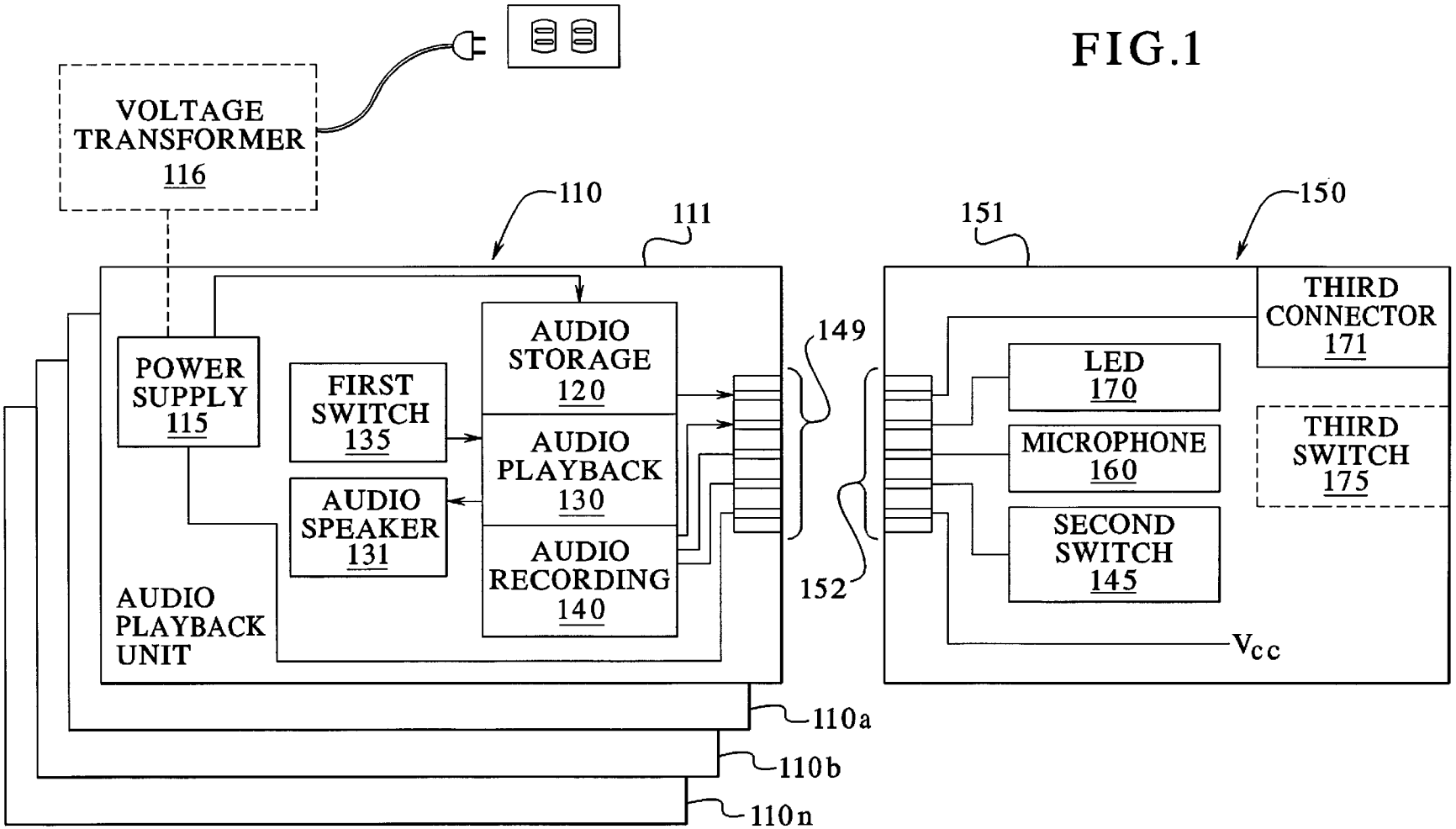
FIG. 1 of the drawings is a block diagram of the present system.

While the present invention may be embodied in many different forms, there is shown in the drawings and discussed herein a few specific embodiments with the understanding that the present disclosure is to be considered only as an exemplification of the principles of the invention and is not intended to limit the invention to the embodiments illustrated.

FIG. 1 of the drawings is a block diagram of the present portable audio recording and playback system 100. The system includes audio playback unit 110 and external recording unit 150. These units are operably yet removably mateable such that a single external recording unit 150 can be used in association with a plurality of audio playback units (i.e. units 110, 110*a*, 110*b* through 110*n*). After recording desired the audio, these audio playback units can then be used as, among other things, talking business cards, talking greeting cards, trading cards and/or distributed with flowers, balloons, in association with toys, action figures or the like to further increase the value of the product.

Figure 2A:
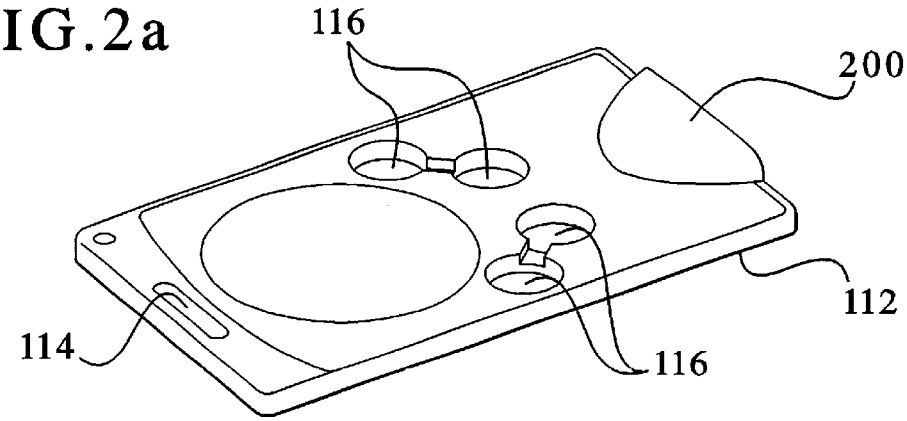
FIG. 2*a* of the drawings is a top perspective view of a particular configuration for the hollow base bottom of the housing for the audio playback unit of the present invention.
Figure 2B:
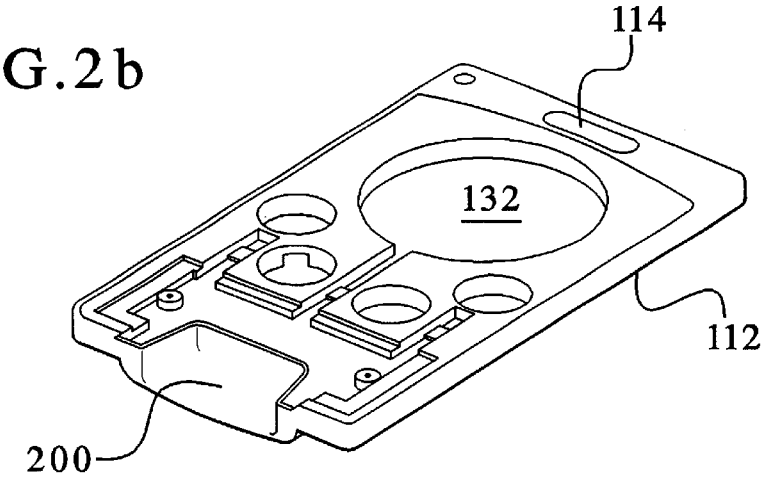
FIG. 2*b* of the drawings is a bottom perspective partial cut-away view of the same particular configuration for the same hollow base bottom of the audio playback unit housing as shown in FIG. 2*a;*
Figure 2C:
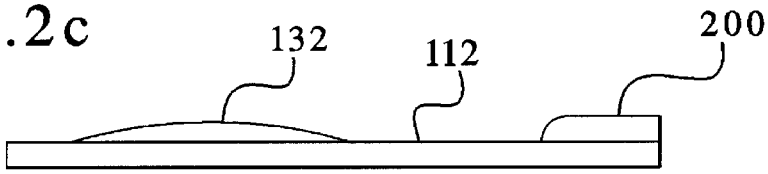
FIG. 2*c* of the drawings is a side elevational view of the same particular configuration of the hollow base portion of the audio playback unit housing shown in FIG. 2*a* and 2*b;*
Figure 2E:
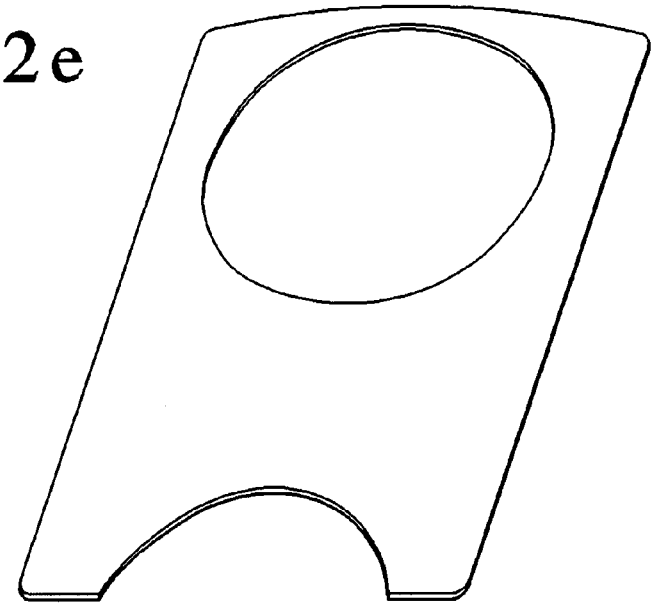
FIG. 2*e* of the drawings is a top perspective view of a back label for covering the bottom of the base portion of the audio playback unit housing.
Figure 2D:
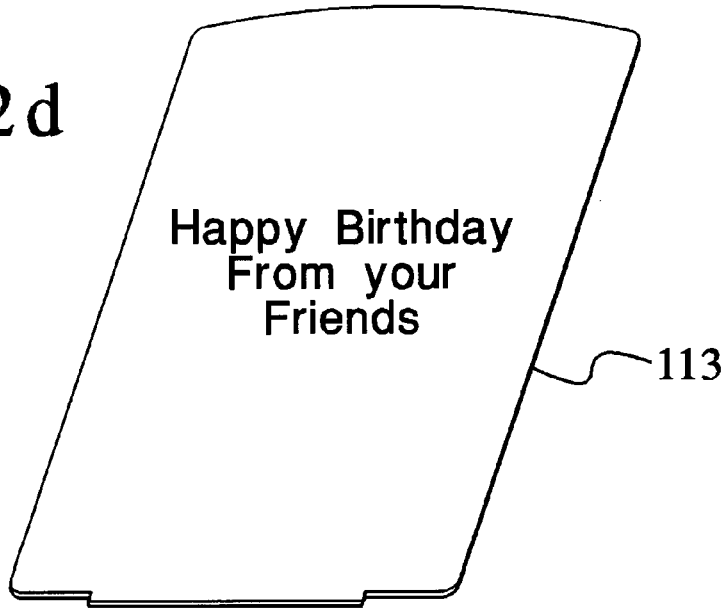
FIG. 2*d* of the drawings is a top perspective view of a front label for covering over the top of the base portion of the audio playback unit housing.

Each of the audio playback units have a playback unit housing 111. One particular configuration of a playback unit housing is shown in FIG. 2*a* through 4*a* of the drawings. This substantially rectangular configuration is a two piece housing comprised of partially hollowed base 112 (shown in FIGS. 2*a*, 2*b* and 2*c*) and substantially flexible label 113 (shown in FIG. 2*d*). As shown in FIG. 2*d*, substantially flexible label 113 is intended to be printed with some indicia, which may be associated with the purpose of distributing the recorded playback unit (i.e. a birthday, "get well" saying or sales pitch). Preferably, flexible label 113 is attached to base 112 with some adhesive, however, other means of attaching the label may also be used. It is contemplated that housing 111 may have different shape and/or construction than the one shown in the drawings, so long as an alternative construction has sufficient internal space to accommodate all of the desired components and a physical area to support interconnection between the playback unit and external recording unit. It is further contemplated that label 113 could be replaced with a pamphlet or other printed material that would be similarly attached to the housing base. As shown in FIGS. 2*a* and 2*b*, housing 111 may also include various externally accessible apertures, such as slot 114 to facilitate attachment of the playback unit housing to ribbon, lanyard, string, a key ring, strap, etc.

Preferably disposed within playback unit housing 111 is power supply 115. This power supply, as suggested by hollow bores 116 (see e.g. FIG. 2*a*) may comprise one or more watch batteries. Power supply 115 supplies all of the power necessary (via DC voltage) for the various electrical components used in system 100. It is contemplated, as well, that power supply 115 need merely be operably associated with playback housing 111 and, thus, may be external to the housing, itself, and operably connected thereto via electrical cabling. Similarly, power supply 115 could alternatively obtain power from an AC mains wall receptacle, step-down and rectify the voltage (perhaps via an external voltage transformer 117 (shown in FIG. 1)) to provide a virtually limitless source of power for the playback unit. However, as would be understood, that type of power supply would obstruct the mobility of playback unit 110, thus making an external power supply less desirable as the main source of supply for system 100. Other potential alternatives for generating the necessary DC supply also includes a solar cell system mounted on the surface of housing 112. The use of batteries may also be combined with any of the possible DC supply alternatives through the use of a diode arrangement that draws power from the batteries only when there is no sufficient alternative DC source. In this manner even the potentially cumbersome approach via connection to an AC mains wall receptacle becomes more desirable. It is further contemplated that rechargeable batteries could be used to power the system. In which case, a simple battery recharging circuit could be added into power supply 115 to facilitate recharging.

Figure 1A:
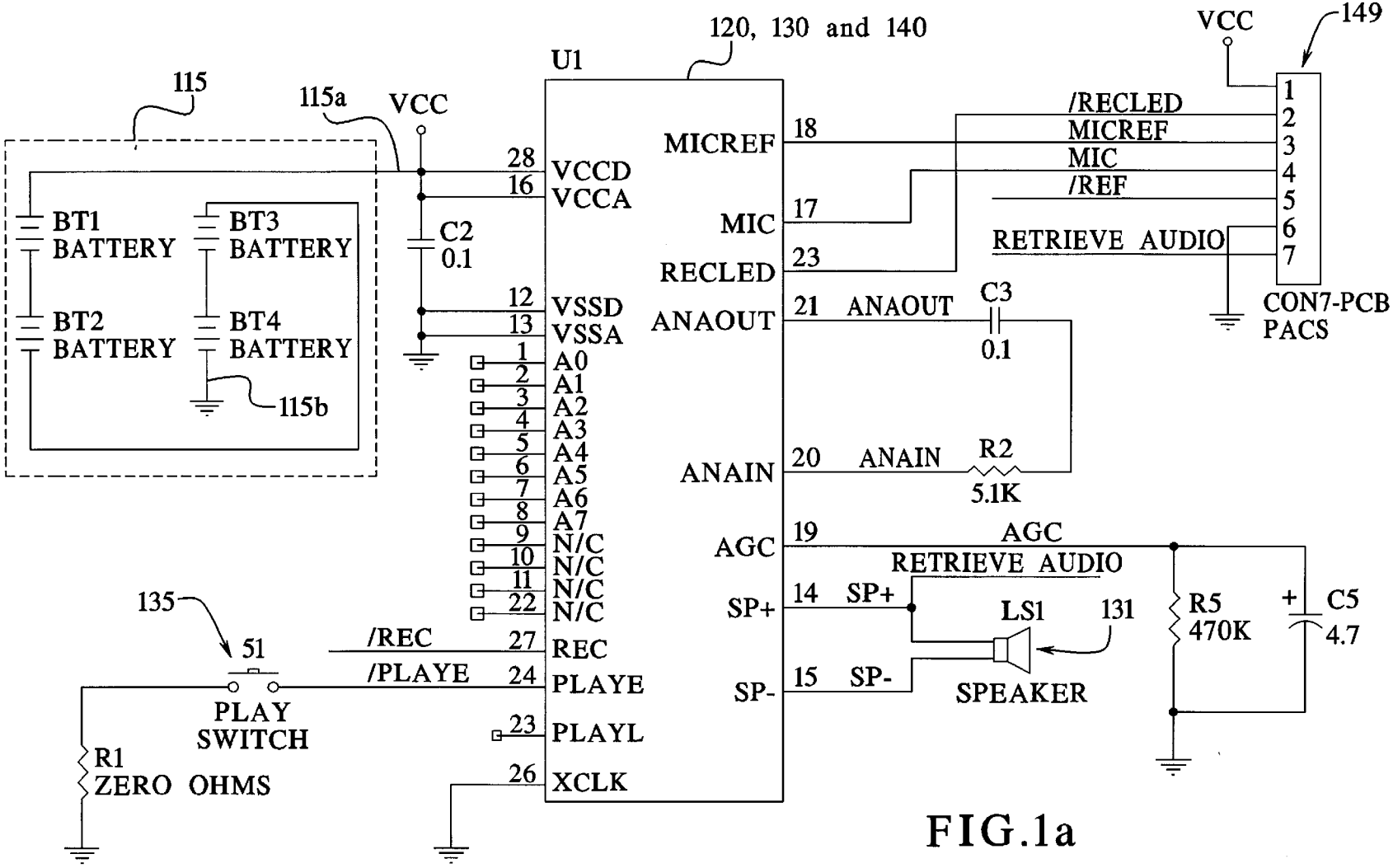
FIG. 1*a* of the drawings is a schematic diagram of one potential embodiment of the audio playback unit of the present invention.

In a preferred embodiment, audio storage 120, audio playback device 130, and audio recording device 140 are disposed within housing 111. In fact, as shown in FIG. 1*a*, in a preferred embodiment, audio storage, audio playback and audio recording functions are provided in a single IC chip solution, which merely requires minimal external components to configure them for operation. Such a single-chip solution is available from Information Storage Devices, Inc ("ISD") of San Jose, Calif. with varying audio storage capabilities (i.e. the ISD1100 series stores up to 12 seconds of audio; ISD1400 series stores up to 20 seconds of audio, so on and so forth).

In one embodiment of the present invention, audio storage 120, audio playback device 130 and audio recording device 140 are mounted on PCB 50 in the standard manner. PCB 50 is designed so as to accept various devices of one particular manufacturer or another. For instance, the various series of the ISD chips have substantially the same pin-out, thus simplifying this process. PCB 50 receives power from power supply 115 via a pair of leaf-spring connections 115*a* and 115*b* (see FIG. 3*b*) disposed below the board in registration with a pair of power pads integral to PCB 50. In this manner the power connections are upwardly biased against the component side of PCB 50 toward providing a flexible easily disengageable connection to the board.

While space constraints may make a single integrated chip solution more desirable, it is contemplated that audio storage 120, audio playback device 130 and audio recording device 140 need not be embodied in the same IC chip. In fact, although space constraints may make it desirable, none of these functional units necessarily have to be provided by integrated chip solutions. Furthermore, audio recording device 140 need not even be disposed within playback unit housing 111. It may, for instance, be disposed within the external recording unit.

Audio storage 120 stores at least one audio segment. While audio storage 120 is rewritable, it is also preferably a semiconductor-based, nonvolatile, zero-power storage device. Such operating characteristics are offered, for instance, by the ISD circuits.

Audio playback device 130 is operably associated with the audio storage for replaying the stored audio upon occurrence of an external prompt. Preferably, the external prompt is provided by first switch 135, which is physically associated with playback unit housing 111 and operably connected to prompt audio playback device 130 to playback at least one audio segment stored in audio storage. First switch 135 may comprise a manually operated switch such as a dimple, push-button or other momentary contact switch (preferably having a small profile) disposed in registration with the upper surface of playback unit housing 111. Alternatively, first switch 135 may comprise a condition-sensitive (i.e. motion, light, heat (to name a few)) switch such that upon the occurrence of a particular condition, audio playback device 130 would playback the stored audio.

In one potential embodiment, audio playback device 140 is further capable of sequentially accessing a particular one of the audio segment saved in the audio storage. In this embodiment, the audio playback unit further including an audio selector switch (not shown) physically associated with playback unit housing 111 and operably connected to the audio playback device toward prompting audio playback device 130 to access the next audio segment in the audio storage.

Audio recording device 140 is operably associated with audio storage 120 and is also operably associated with microphone 160, which itself is physically associated with external recording unit 150. Audio recording device 140 is operably connected to second switch 145, which prompts recording of an audio segment. Preferably, second switch 145 is also physically associated with external recording unit 150 such that a recipient of a pre-recorded playback unit cannot simply alter the pre-recorded audio (even if the audio recording device 140 is disposed within playback unit housing 111) because that recipient is not likely to have an external recording unit. Second switch 145 need not be disposed within any particular housing, though, because external recording unit 150 may not be intended for mass distribution, thus, allowing a less portable solution to be implemented.

Figure 3C:
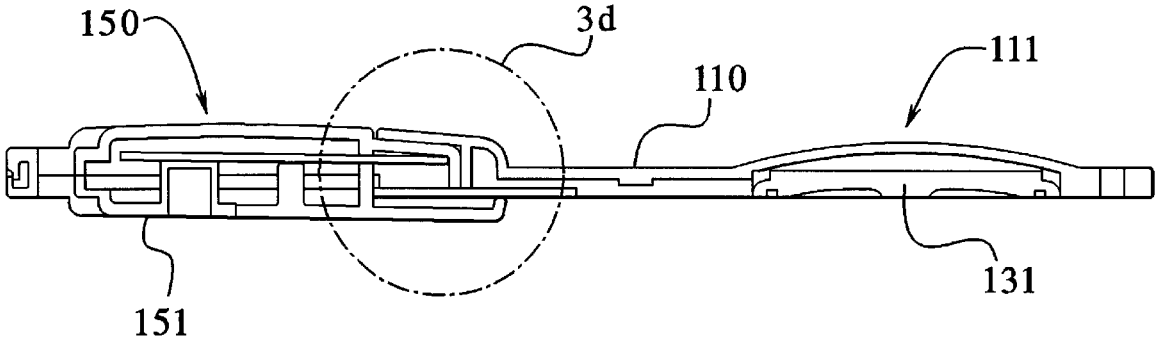
FIG. 3*c* of the drawings is a cross sectional view of the audio playback unit operably yet removably connected to the external recorder taking along sight line 3*c*—3*c* shown in FIG. 3*b;*

Audio speaker 131 is physically associated with housing 111 (see FIGS. 3*b* and 3*c*) and operably associated audio playback device 130 (see FIGS. 1 and 1*a*). As shown in FIGS. 1 and 3*b*, in a preferred embodiment, audio speaker 131 is disposed within housing 111, however, it is contemplated that for certain applications it may be desirable for speaker 131 to be placed externally to housing 111. In the preferred embodiment of the present system wherein housing 111 is constructed from at least partially hollow base 112 having a bottom and a top, audio speaker 131 is disposed within speaker cavity 132 (shown in FIGS. 2*b* and 2*c*) facing the hollow base bottom (see FIG. 3*b* and 3*c*). By facing the speaker downwardly toward the rigid housing base, the fragile portion of the speaker is more protected from external prodding. In this preferred embodiment, speaker cavity 132 has hemispherical-shaped audio cavity 133 (see FIGS. 2*c* and 3*c*) disposed in operable registration with the speaker such that the audio generated by speaker 131 is resonated in speaker cavity 132 and reflected back toward the top of housing 111. In the preferred embodiment, the pertinent measurement of the speaker cavity are: cavity gap (speaker bottom to sphere bottom): 3.5 mm; diameter of the outer lip: 39 mm; and the radius of the edge of the sphere: 60.5 mm. Of course, other dimension may also form an acceptable resonance and reflectivity.

Each audio playback unit 110 also includes first connector 149 physically associated with playback unit housing 111 and operably associated with at least one of audio playback device 130 and audio storage 120. In the preferred embodiment shown in the drawings, first connector 149 is comprised of a plurality of edge connectors formed integrally on PCB 50 that supports audio storage 120, audio playback device 130 and audio recording device 140. Other types of mateable connectors could be alternatively used as would be known to those of ordinary skill in the art.

FIG. 1*a* of the drawings is a schematic diagram of one particular embodiment of the electronics in the audio playback unit. In particular, this schematic represents a configuration centered around U1—an ISD1112X Single-Chip Voice Record/Playback Device from ISD, Inc. of San Jose Calif. Thus, in this embodiment, U1 provides the functionality of audio storage 120, audio playback device 130 and audio recording device 140. As shown, power supply 115 is connected to the power pins of U1; first switch 135 is directly connected to the "play" activation pin of U1; and audio speaker 131 is directly driven by an output pin of U1. Additionally, first connector 149 receives various signals including the microphone audio signal which is connected to the "MIC" input pin of U1 and a signal from second switch 145 transmitted on "/REC." The various discrete biasing components shown are configured according to the manufacturer's data sheets.

Figure 3D:
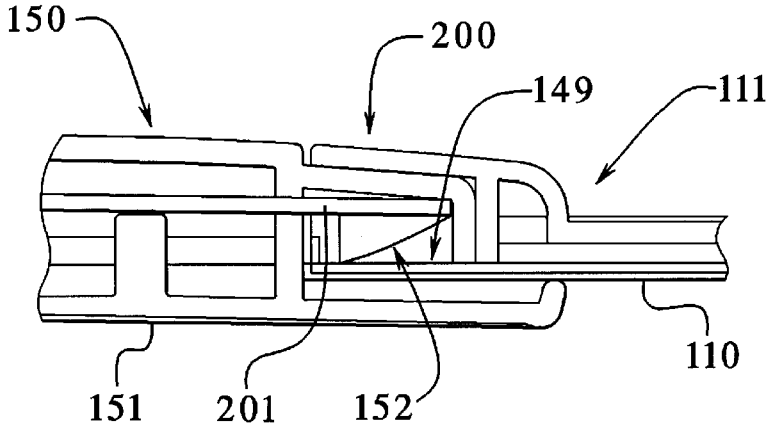
FIG. 3*d* of the drawings is a close up view of a portion of FIG. 3*c* showing, in particular, the mating of the first and second connectors.
Figure 4A:
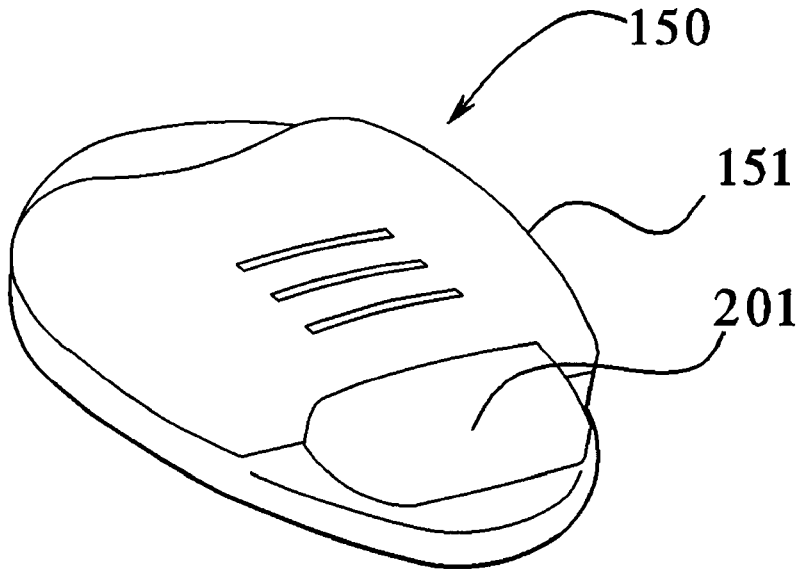
FIG. 4*a* of the drawings is a top perspective view of the external recording unit.
Figure 4B:
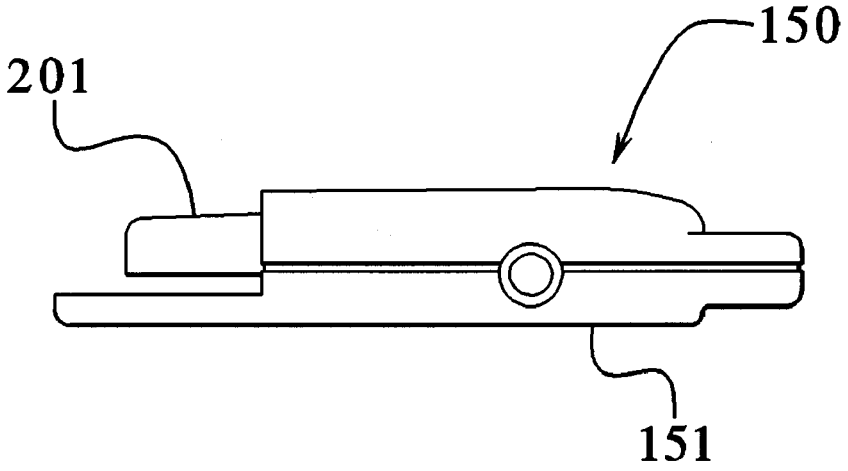
FIG. 4*b* of the drawings is a side elevational view of the external recording unit.

External recording unit 150 includes second connector 152 physically associated with recording unit housing 151 and operably associated with both of microphone 160 and second switch 145. Second connector 152 is configured to be operably yet removably mateable to first connector 149. As shown in FIG. 3*d*, in the preferred embodiment, second connector 152 is comprised of a plurality of upwardly biased pins configured with a camming surface. In this manner as first and second connectors are brought into registration, PCB 50 slides over the upwardly biased pins, in turn pushing those pins slightly downward. The upward biasing of the pins ensures a positive connection and assists in maintaining the physical connection between the first and second connectors. Other mateable connectors may alternatively be used.

As would be understood by those of ordinary skill in the art, the number of "lines" in both of the first and second connectors will generally be the same with those connector lines being distributed relative to each other and to the lines in the mating connector to ensure proper one-to-one registration toward transmitting the appropriate signal(s) between the playback and external recording units.

Appropriate alignment and interconnection between first and second connectors may be ensured via physical constraints on the connectors. For instance, in the preferred embodiment shown in the drawings, the first and second connectors 149 and 152 are physically protected by at least protective portions of their respective housings 111 and 151. As shown in FIG. 3*d*, these protective portions 200 and 201 cooperatively mate one to another forming an interference fit. While this interference fit alone may be sufficient to ensure appropriate connection as noted above in the preferred embodiment, second connector 152 is already upwardly biased to promote efficient connection between first and second connectors, this biasing further increases the frictional engagement between the cooperatively mating portion of housings. Additionally or even alternatively a dimples and corresponding notches; a tongue and corresponding groove; or other similar physical interlocking structure can be formed integrally to or added onto the housings to ensure mating for the desired period.

External recording unit 150 includes at least microphone 160 and second switch 145. As noted above microphone 160, which generates a microphone audio signal supplies that signal for use by audio recording device 140. Thus, in the preferred embodiment, the microphone audio signal is transmitted via second and first connectors to the audio recording device physically associated with playback unit 110. Second switch 145 controls the operation of audio recording device 140. Upon activation of second switch 145, audio recording device 140 records an audio segment until deactivation of that second switch. In a preferred embodiment, external recording unit 150 further includes LED 170 to indicate that the unit is currently recording audio. In the preferred embodiment, LED 170 is driven by the ISD1112X. Of course, one of ordinary skill in the art can easily fashion a biasing circuit for this purpose.

One purpose of disposing the microphone and "recording" (or second) switch in this separate housing is, in large part, to dissuade recipients of audio playback unit 110 from re-recording over the audio message recorded by the sender. Another purpose behind this separation of these components is to reduce the cost of the audio playback unit portion of the system. As shown in FIG. 1, a single external recording unit can be used to record the audio onto a plurality of audio playback units.

In view of these purposes, as well as other purposes which will become apparent to those of ordinary skill in the art having the specification, drawings and claims before them, any of the microphone or the second switch could be moved to audio playback unit 110, with a resulting increase in cost while still precluding the recipient from re-recording over the desired audio message. Thus, in this manner it is contemplated that either the microphone or the second switch could instead be physically associated with the audio playback unit rather than the external recording unit. Similarly, it would be understood by one of ordinary skill in the art that it would be desirable to move audio recording device 140 from audio playback unit 110 to external recording unit 150, if possible, to lower the redundant cost caused by the distributing the audio recording device with each audio playback unit.

Similarly, it should be noted that in the preferred embodiment, all of the power for external recording unit 150 is provided via first and second connectors from power supply 115, which is physically associated with audio playback unit 110. It is contemplated that external recording unit 150 could include its own power supply. Such a design would reduce the number of lines necessary on first and second connectors, but increase the number of components necessary in the external recording unit.

Figure 1B:
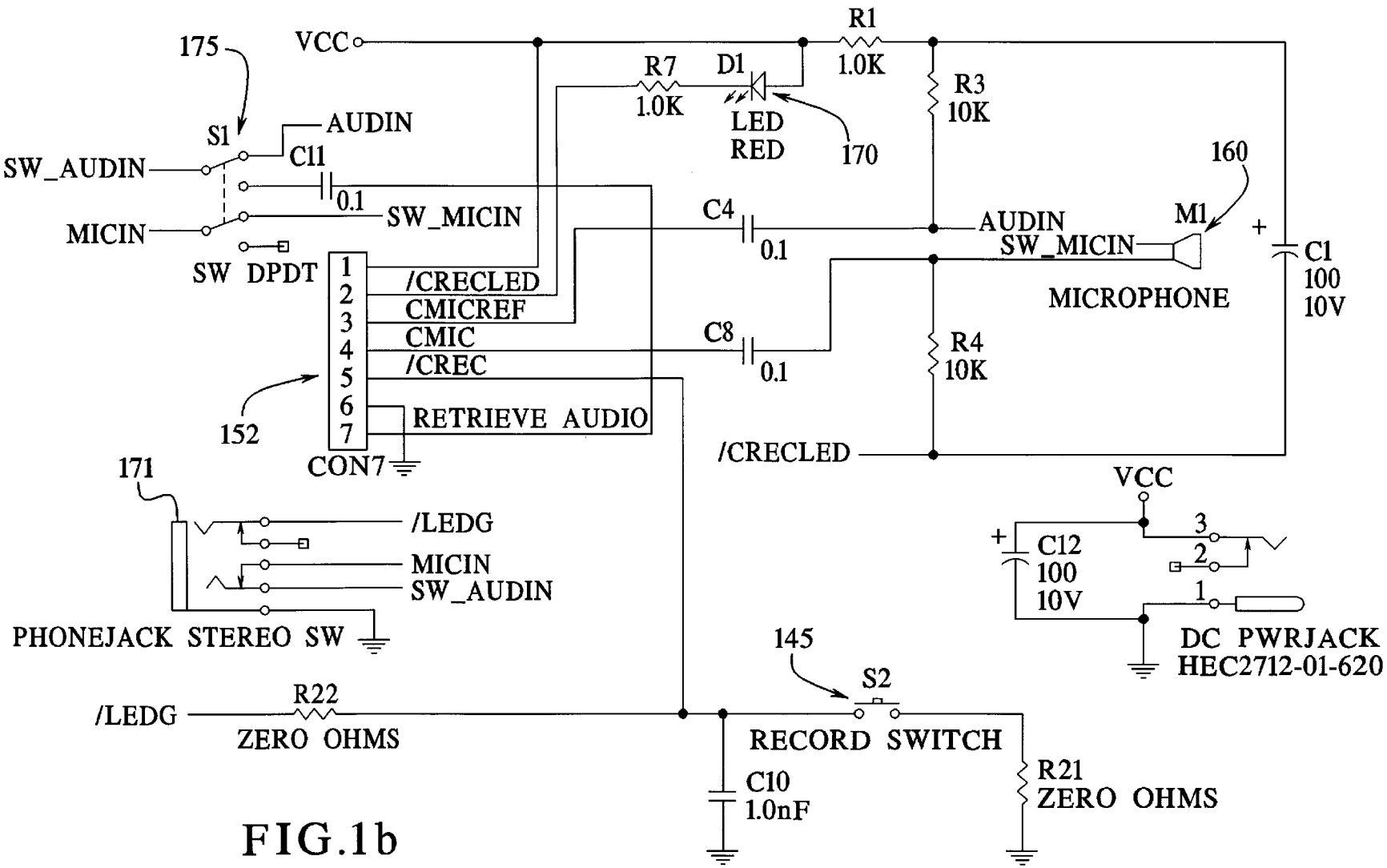
FIG. 1*b* of the drawings is a schematic diagram of one potential embodiment of the external recording unit.

FIG. 1*b* of the drawings is a schematic diagram of the external recording unit portion of the present system. As shown in the figure with respect to the particular embodiment, microphone 160 is operably connected to a portion of second connector 152. Similarly, LED 170 and second switch 145 are also connected to the second connector. Additionally connected to second connector 152 is a bi-directional audio path ("Retrieve Audio"), thus, the "retrieve audio" line provides another transmission of the played back audio. As further shown in the drawing, this audio can then be switched onto third connector 171 physically associated with recording unit housing 151. Third connector 171 accepts and/or transmits an external audio signal. Third switch 175 is physically associated with the external recording unit and operably associated with the microphone, the third connector and the audio recording device. The third switch selects between the external audio signal and the microphone audio signal. While audio is flowing, LED 170 is lit to indicate successful recording through the operation of "/LEDG" and/or second switch 145. This LED is configured to allow the LED to be lit during only recording and/or down loading of audio.

Such an audio dump via third connector 171 may be used in association with a damaged playback unit to obtain the audio for insertion into a different set of playback and external recording units. In fact, it is conceivable that the audio could stream out of the third connector on one external recording unit and be fed into a second external recording unit and then onto the audio storage in that second system's playback unit. This third connector could also be used to receive audio from various recording and/or sound generation devices.

Figure 5:
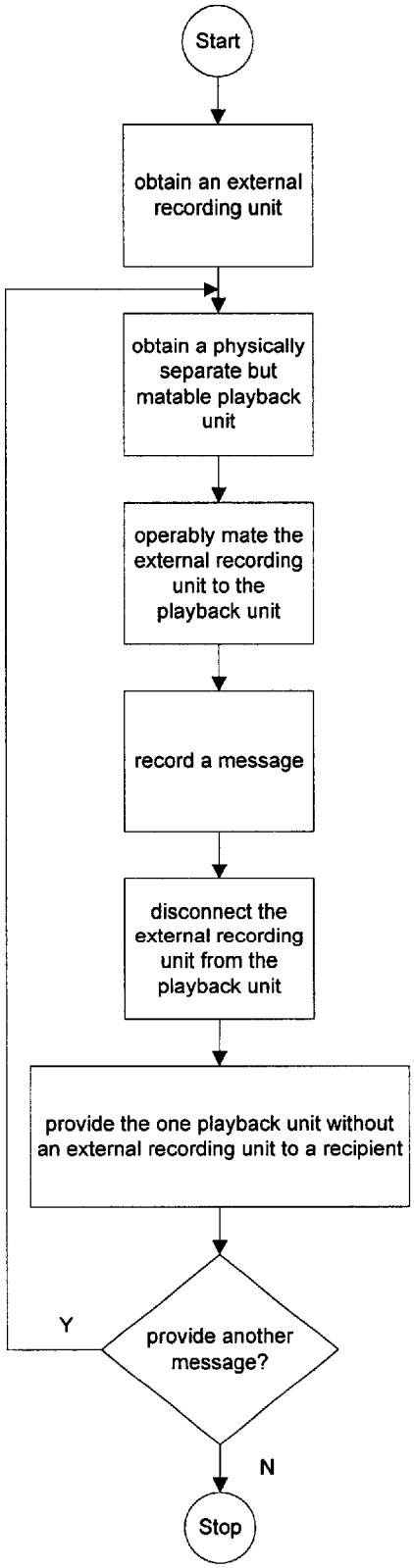
FIG. 5 of the drawings is a flow diagram of a method of using the present system.

FIG. 5 of the drawings is a flow diagram of a method of using the present system. In particular, a user (such as a florist) obtains an external recording unit from a manufacturer or distributor of the present system. The user also obtains at least one physically separate but meteable playback unit from the same or alternate source. The user mates the external recording unit to the playback unit to form a operable portable audio recording and playback system. The user then uses the external recording unit to record an audio message that is stored on the playback unit. Next, the user disconnects the external recording unit from the playback unit. The user then provides the one playback unit having the audio message recorded therein to a recipient without providing the recipient with the external recording unit. Without having to obtain another external recording unit, the user can then repeat the foregoing method for each playback unit obtained.

The foregoing description and drawings merely explain and illustrate the invention and the invention is not limited thereto. Those of the skill in the art who have the disclosure before them will be able to make modifications and variations therein without departing from the scope of the present invention.

What is claimed is:

1. A portable audio recording and playback system comprising:

an audio playback unit having:

a playback unit housing including an at least partially hollow base having a bottom, a top, and a hemispherical-shaped audio cavity, a power supply operably associated with said playback unit housing, audio storage disposed within said playback unit housing, said audio storage storing at least one audio segment, an audio playback device within said playback unit housing, said audio playback device being operably associated with said audio storage, an audio speaker physically associated with said playback unit housing, said audio speaker being operably associated with said audio playback device, said audio speaker being disposed in said playback unit housing facing said hollow base bottom and disposed in operable registration with said audio cavity such that audio generated by said audio speaker is resonated in said audio cavity and reflected back toward said hollow base top of said playback unit housing, a first switch physically associated with said playback unit housing and operably connected to said audio playback device toward prompting same to playback at least one of said at least one audio segment, and a first connector physically associated with said playback unit housing and operably associated with at least one of said audio playback device and said audio storage an external recording unit having a recording unit housing, microphone physically associated with said recording unit housing, said microphone generating a microphone audio signal, a second switch physically associated with said external recording unit housing, and a second connector physically associated with said recording unit housing and operably associated with both of said microphone and said second switch, said first and second connectors being configured such that each is operably yet removably mateable to the other; and an audio recording device being operably associated with said microphone and said audio storage, said audio recording device being operably connected to said second switch toward prompting said same to record one of said at one audio segment.

2. The invention according to claim 1 wherein said first connector is physically protected by at least a protective portion of said playback unit housing.

3. The invention according to claim 1 wherein said second connector is physically protected by at least a protective portion of said recording unit housing.

4. The invention according to claim 1 wherein at least a portion of said protective portion of said playback unit housing cooperatively mates with at least a portion of said protective portion of said recording unit housing.

5. The invention according to claim 1 wherein said cooperatively mating portion of said protective portions of said playback unit and recording unit housing form an interference fit.

6. The invention according to claim 1 wherein said second connector is upwardly biased to promote efficient connection between said first and second connectors and further increase frictional engagement between said cooperatively mating portion of said protective portions of said playback unit and recording unit housings.

7. The invention according to claim 1 wherein said audio playback device is capable of sequentially accessing a particular one of said at least one audio segment in said audio storage, said audio playback unit further including:

an audio selector switch physically associated with said playback unit housing and operably connected to said audio playback device toward prompting said audio playback device to access a next one of said at least one audio segment in said audio storage.

8. The invention according to claim 1 wherein said third connector is capable of further transmitting said at least one audio segment to an external audio device.

9. The invention according to claim 1, wherein said audio playback unit housing and said external recording unit housing are physically separate, yet mateable via said first connector and said second connector.

10. The invention according to claim 1, wherein said external recording unit is operably powered by said power supply of said audio playback unit via said first connector and said second connector.

11. A portable audio recording and playback system comprising:

an audio playback unit having:

a playback unit housing, a power supply operably associated with said playback unit housing, audio storage disposed within said playback unit housing, said audio storage storing at least one audio segment, an audio playback device within said playback unit housing, said audio playback device being operably associated with said audio storage, an audio speaker physically associated with said playback unit housing, said audio speaker being operably associated with said audio playback device, a first switch physically associated with said playback unit housing and operably connected to said audio playback device toward prompting same to playback at least one of said at least one audio segment, and a first connector physically associated with said playback unit housing and operably associated with at least one of said audio playback device and said audio storage an external recording unit having a recording unit housing, microphone physically associated with said recording unit housing, said microphone generating a microphone audio signal, a second switch physically associated with said external recording unit housing, a second connector physically associated with said recording unit housing and operably associated with both of said microphone and said second switch, said first and second connectors being configured such that each is operably yet removably mateable to the other, a third connector physically associated with said recording unit housing, said third connector at least accepting an external audio signal, and a third switch physically associated with said recording unit housing, said third switch being operably associated with said microphone, said third connector and said audio recording device, said third switch selects between said external audio signal and said microphone audio signal; and an audio recording device being operably associated with said microphone and said audio storage, said audio recording device being operably connected to said second switch toward prompting said same to record one of said at one audio segment.

* * * * *